United States Patent [19]

Yamai et al.

[11] Patent Number: 4,542,448

[45] Date of Patent: Sep. 17, 1985

[54] LAMP ASSEMBLY

[75] Inventors: Yoshihiro Yamai; Hideo Hamamoto; Masami Nishibe, all of Toyota, Japan

[73] Assignee: Toyota Jidosha Kabushiki Kaisha, Toyota, Japan

[21] Appl. No.: 573,656

[22] Filed: Jan. 25, 1984

[30] Foreign Application Priority Data

Jan. 27, 1983 [JP] Japan ..... 58-11563

[51] Int. Cl.[4] ..... F21V 5/00

[52] U.S. Cl. ..... 362/268; 362/331; 362/335; 362/339; 362/351; 362/375; 362/311

[58] Field of Search ..... 362/293, 339, 268, 331, 362/61, 335, 351, 375, 311

[56] References Cited

U.S. PATENT DOCUMENTS 3,622,231 11/1971 Hansen ..... 362/331

*Primary Examiner*—Stephen J. Lechert, Jr.

*Attorney, Agent, or Firm*—Finnegan, Henderson, Farabow, Garrett and Dunner

[57] ABSTRACT

Lamp assembly consisting of a housing with an opening containing a bulb, a frenel lens, a condenser lens and an outer lens installed in the housing nearest to the opening which allow the beams from the condenser lens to pass through plurality of portions pervious to light corresponding to the condenser lens respectively of which surfaces have the different tilt angles with each other, through which the refracted beams are radiated in such a manner that their refracted directions have in turn a gradual tendency of tilting.

1 Claim, 2 Drawing Figures

LAMP ASSEMBLY

BACKGROUND OF THE INVENTION

This invention relates to an improved lamp for use in vehicles and beacon lights and so forth. The conventional lamps for use as beacon lights or for illumination, especially in vehicles comprise a housing containing a bulb, an inner lens having so-called frenel lens which converts the light radiated from the bulb into parallel rays of light, a condenser lens consisting of a plurality of convex lenses on the surface facing the bulb and concave lens on the opposite surface. The condenser lens condenses the parallel rays of light into a plurality of beams consisting of parallel rays of light. An outer lens having pervious portions receives light corresponding to the beams radiated from the condenser lens. In this case, the outer lens is usually a flat plate.

In the lamp of this kind, from the nature of it, a high degree of illumination is required, however the lamps having such construction as mentioned above have drawbacks. That is, the light radiated from the outer lens is apt to have an uneveness in its brightness in the direction of the beams, thus reducing the effectiveness of the illumination of the lamp.

SUMMARY OF THE INVENTION

An object of the present invention is to provide a lamp assembly capable of improving the illuminating effect of the light radiated from it.

Another object of the present invention is to provide a lamp capable of radiating light in a desired amount.

For this purpose, there is provided a lamp assembly comprising a lamp housing with an opening for receiving a bulb, an optical element, i.e. frenel lens, installed in the housing in such a manner as to receive the from the bulb and convert it into parallel rays of light, a condenser lens provided in the housing parallel to the optical element allowing the condenser lens to receive parallel rays of light from the optical element and convert the rays into a plurality of parallel beams and an outer lens installed in the housing nearest to the opening and parallel to the former two lenses, which allows the beams to pass through a plurality of portions pervious to light each of which has the surfaces of different tilt angles respectively, through which the refracted beams are radiated in such a manner that their refracted directions tend to be gradually tilting.

BRIEF DESCRIPTION OF THE DRAWINGS

An embodiment of the present invention will now be described by way of example and with reference to the accompanying drawings in which.

DESCRIPTION OF THE PREFERRED EMBODIMENTS

Figure 1:
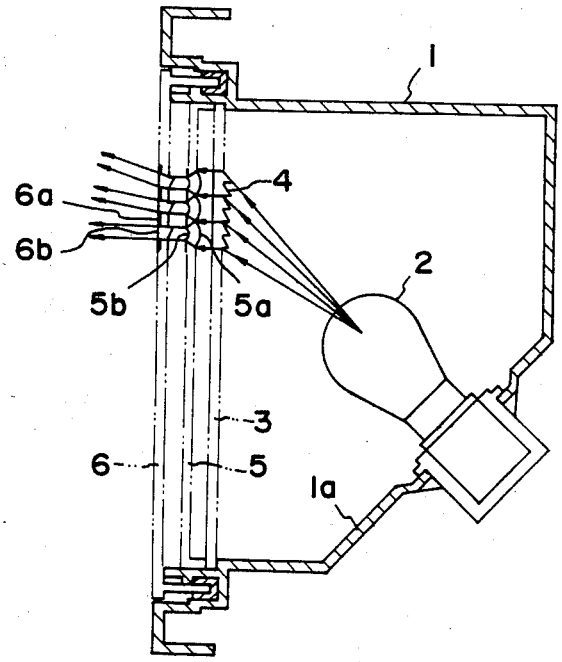
FIG. 1 is a cross-sectional view illustrating a preferred embodiment of the present invention.
Figure 2:
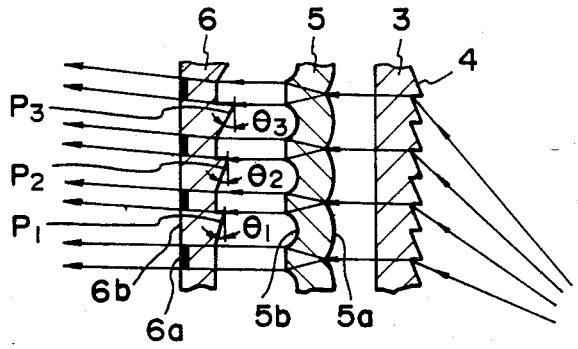
FIG. 2 is a cross-sectional view of the principal part of the light pervious portion in FIG. 1.

Referring now to FIGS. 1 and 2, a preferred embodiment of the present invention will be described. In the drawings, there is shown lamp housing 1 with an opening, wherein a bulb 2 is installed on an upwardly inclined surface 1*a* of the lower side of the housing 1. There is also an optical element having an inner lens 3 installed in the opening of the housing for converting the light of the bulb into parallel rays of light. Inner lens

3 includes prisms 4 formed as a frenel lens on the surface facing the bulb 2. A condenser lens 5 is fixed parallel to the frenel lens in an adjacent opening further away from bulb 2 than the inner lens 3. On the surface of the condenser lens 5 facing the inner lens 3, there are formed a number of convex surfaces 5*a* as shown in FIG. 2. Sectionally concave surfaces 5*b* are formed on the opposite surface of the condenser lens 5 from concave surfaces 5*b*. The convex surfaces and the concave surfaces of the condenser lens 5 are so designed as to condense the parallel rays of light passed through the inner lens 3 into the beams having the preselected width measured in the vertical direction corresponding to the diameter of the concave surface 5*b*. An outer lens 6 is fixed adjacent condenser lens 5 within housing 1. The surface of the outer lens 6 opposite to condenser lens 5 is covered with a light shading coat at spaced intervals along the vertical lens portion receiving light through concave surfaces 5*b*. The portion covered with a coat is defined as a light-shade 6*a*, whereas the portion without being covered with the coat is defined as a portion 6*b* and is pervious to light. Each of the portions 6*b*, which are pervious to light, is formed at a location facing each concave surface 5*b*. The width of the portion 6*b* is so arranged as to correspond to the beams from the concave surface 5*b*. On the surfaces of portions 6*b* opposite to the condenser lens 5, there are formed prismatic surfaces $P_1$, $P_2$, $P_3$. Tilt angles $\theta_1$, $\theta_2$, $\theta_3$ of the prismatic surfaces $P_1$, $P_2$, $P_3$ are so constructed that the beams are altered and made gradually greater in the upward direction while light is radiated.

The action of the lamp thus constructed will be now described. When the light by the bulb 2 is reflected by prism 4 of the inner lens 3, the light is converted into parallel rays of light and proceeds to the condenser lens 5. While the parallel rays of light are incident on the convex surface 5*a* of the condenser lens 5 and emitted through the concave surface 5*b* thereof, the rays converged into a parallel beam having the width corresponding to the size of the concave surface 5*b*. Then the parallel beam is allowed to pass through the portion 6*b* of the outer lens 6 and emitted out of the housing 1. Since the tilt angles of the prismatic surfaces $P_1$, $P_2$, $P_3$ of the portions 6*b* pervious to light are made different and gradually greater in the upward direction, the light emitted from the outer lens 6 is upwardly radiated unlike the conventional case and the luminous distribution becomes uniform to that extent. This results in making brighter the light emission surface of the upper side of the outer lens 6, thus improving its illumination. Moreover, although the optical element in the form of an inner lens 3 for converting the bulb light into parallel rays of light is fixed to the opening of the housing 1, an optical element for that purpose such as a paraboloidal reflex mirror may be installed on the bottom side of the housing 1 for that purpose instead.

What is claimed is:

1. A lamp assembly comprising:

a housing having an opening;

a bulb for emitting light mounted within said housing;

optical element means positioned within the opening of said housing for converting the light from said bulb into parallel rays;

a condenser lens aligned adjacent said optical element means and including complementary pairs of concave and convex elements on opposing sides of said lens for converting said parallel rays passing through said optical element means into beams of light;

an outer lens adjacent said condenser lens and receiving said light beams, said outer lens including an inside surface having a plurality of angularly displaced surfaces arranged consecutively, each of said angularly displaced surfaces being tilted at an angle more than 90 degrees from the horizontal, the tilt of said angularly displaced surfaces gradually increasing in inclination upwardly along the plane of said outer lens; and shaded means on the outer surface of said outer lens for restricting the radiation of light emitted from said housing.

* * * * *